US007819257B2

(12) United States Patent
Bart et al.

(10) Patent No.: US 7,819,257 B2
(45) Date of Patent: Oct. 26, 2010

(54) DEVICE FOR REMOVING HEAVY CONTAMINANTS FROM AN APPARATUS FOR TREATING A FIBROUS SUSPENSION, IN PARTICULAR FROM A HYDROCYCLONE THAT CAN BE OPERATED FOR CLEANING A FIBROUS SUSPENSION

(75) Inventors: Roman Bart, Friedrichshafen (DE); Juergen Futterer, Horgenzell (DE); Michael Piper, Appleton, WI (US)

(73) Assignee: Voith Patent GmbH, Heidenheim (DE)

( * ) Notice: Subject to any disclaimer, the term of this patent is extended or adjusted under 35 U.S.C. 154(b) by 554 days.

(21) Appl. No.: 11/681,379

(22) Filed: Mar. 2, 2007

(65) Prior Publication Data

US 2007/0216500 A1 Sep. 20, 2007

(30) Foreign Application Priority Data

Mar. 4, 2006 (DE) ..... 20 2006 003 421 U

(51) Int. Cl.
*B04C 5/12* (2006.01)

(52) U.S. Cl. ..... 209/722; 209/710; 209/721; 209/728; 209/732; 210/512.1

(58) Field of Classification Search ..... 209/142, 209/156, 710, 716, 722
See application file for complete search history.

(56) References Cited

U.S. PATENT DOCUMENTS 3,533,506 A * 10/1970 Carr ..... 210/512.1
3,568,847 A * 3/1971 Carr ..... 210/512.1
3,861,532 A * 1/1975 Skardal ..... 209/728
4,317,716 A * 3/1982 Liller ..... 209/732
4,378,289 A * 3/1983 Hunter ..... 209/722
4,629,555 A * 12/1986 Colman et al. ..... 209/721

* cited by examiner

*Primary Examiner*—Patrick Mackey
*Assistant Examiner*—Terrell H Matthews
(74) *Attorney, Agent, or Firm*—Greenblum & Bernstein, P.L.C.

(57) ABSTRACT

Device and method for removing heavy contaminants from an apparatus for treating a fibrous suspension. The device includes at least one connection part being coupleable to a heavy contaminants outlet of the apparatus. The at least one connection part includes an inner surface having a polygonal cross section and at least one heavy contaminants outlet.

13 Claims, 2 Drawing Sheets

DEVICE FOR REMOVING HEAVY CONTAMINANTS FROM AN APPARATUS FOR TREATING A FIBROUS SUSPENSION, IN PARTICULAR FROM A HYDROCYCLONE THAT CAN BE OPERATED FOR CLEANING A FIBROUS SUSPENSION

CROSS-REFERENCE TO RELATED APPLICATIONS

The present application claims priority under 35 U.S.C. §119 of German Patent Application No. 20 2006 003 421.8 filed Mar. 4, 2006, the disclosure of which is expressly incorporated by reference herein in its entirety.

BACKGROUND OF THE INVENTION

1. Field of the Invention

The invention relates to a device for removing heavy contaminants from an apparatus for treating a fibrous suspension, in particular from a hydrocyclone for separating heavy contaminants from a fibrous suspension.

2. Discussion of Background Information

In many cases the fibrous suspension designated for paper production must be cleaned of the refuse contained therein—so-called foreign particles. This applies in particular in the case of recovered paper preparation.

Hydrocyclones are able to concentrate and drain out heavy contaminants in fibrous suspensions by centrifugal force. They are generally used in the removal of metal parts, glass fragments and stones. The materials or parts removed from the suspension in this manner can be removed from the closed system by a junk trap being attached to the corresponding devices. It is known per se how an extraction device of this type works: in general it has two shut-off devices, e.g., a first and a second slider, between which a lock chamber is located. As long as the first slider, which produces the connection between the lock chamber and the system guiding the suspension, is opened, the lock chamber fills continuously with the refuse to be removed. In other cases it is possible to keep the first slider closed for a longer period and to open it only in a time cycle, so that part of the refuse concentrated in the system reaches the lock chamber in batches. The actual extraction is carried out by closing the first slider and opening the second slider, whereby the contents located in the lock chamber can be emptied. As a rule, the contents fall out of the lock chamber due to their weight; but they can also be suctioned off or rinsed out. Extraction devices of the type under consideration here are usually operated automatically, i.e., a clocked control takes place whereby the shut-off devices open and close automatically.

SUMMARY OF THE INVENTION

The present invention reduces the wear due to rotating heavy contaminants.

According to the invention, the device includes at least one connection part for direct or indirect attachment to the heavy contaminants outlet of the apparatus. In this manner, the connection part is provided with at least one heavy contaminants outlet. Further, the connection part has a polygonal cross section on its inner surface.

With the aid of the connection part described, it is namely possible to influence the flow therein such that a rotational flow gradually slowing down is formed, preferably in interaction with an added liquid (e.g., backwater from the device), which rotational flow carries the suspension flowing in from above. This has the advantage in particular that the wear is substantially reduced in the connection part itself and on the connecting pieces, e.g., a slide plate. The sinking heavy contaminants are separated from fibers or fiber parts in the connection part, can easily sink downwards and collect on the bottom. The fibers, however, reach the center of the connection part with the water and from there they ultimately reach the accepts outlet.

The present invention is directed to a device for removing heavy contaminants from an apparatus for treating a fibrous suspension. The device includes at least one connection part being coupleable to a heavy contaminants outlet of the apparatus. The at least one connection part includes an inner surface having a polygonal cross section and at least one heavy contaminants outlet.

According to a feature of the invention, the apparatus can be a hydrocyclone for separating heavy contaminants from a fibrous suspension.

In accordance with another feature, the at least one connection part can be one of directly or indirectly coupleable to the heavy contaminants outlet of the apparatus.

Further, the at least one connection part can further include at least one attachment for adding liquid. The at least one attachment can open in an area of the polygonal inner surface. The at least one attachment may be tangentially arranged on the at least one connection part.

According to another feature of the instant invention, the apparatus can include a hydrocyclone, and at least one connection part may be coupleable to the hydrocyclone such that a centerline of the at least one connection part is aligned with a centerline of the hydrocyclone.

The polygonal inner surface can be essentially formed as a square, and the square can have rounded corners.

Moreover, the device can further include an attachment device positionable between the at least one connection part and the heavy contaminants outlet of the apparatus. The attachment part may have a cylindrical wear-resistant lining. The wear-resistant lining may be a ceramic liner.

In accordance with still another feature of the invention, the device can further include two sliders arranged to embody the at least one connection part as a junk trap.

The at least one connection part may be formed with an axial extension greater than an inside diameter of the heavy contaminants outlet of the apparatus. The axial extension can be 1.5 to 5 times larger than the inside diameter of the heavy contaminants outlet of the apparatus.

According to a further feature of the instant invention, the at least one connection part can be detachably coupleable to apparatus.

The invention is directed to a method of removing heavy contaminants from a fibrous suspension. The method includes separating heavy contaminants from a suspension in a separating device, and receiving the heavy contaminants in a connection part coupleable to a heavy contaminants outlet of the separating device. The connection part has a cross sectionally polygonal inner surface.

According to a feature of the invention, the separating device can be a hydrocyclone.

According to another feature, the method can further include adding fluid to the connection part.

In accordance with still yet another feature of the present invention, the method can include removing the heavy contaminants from the connection part through activation of a slider.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
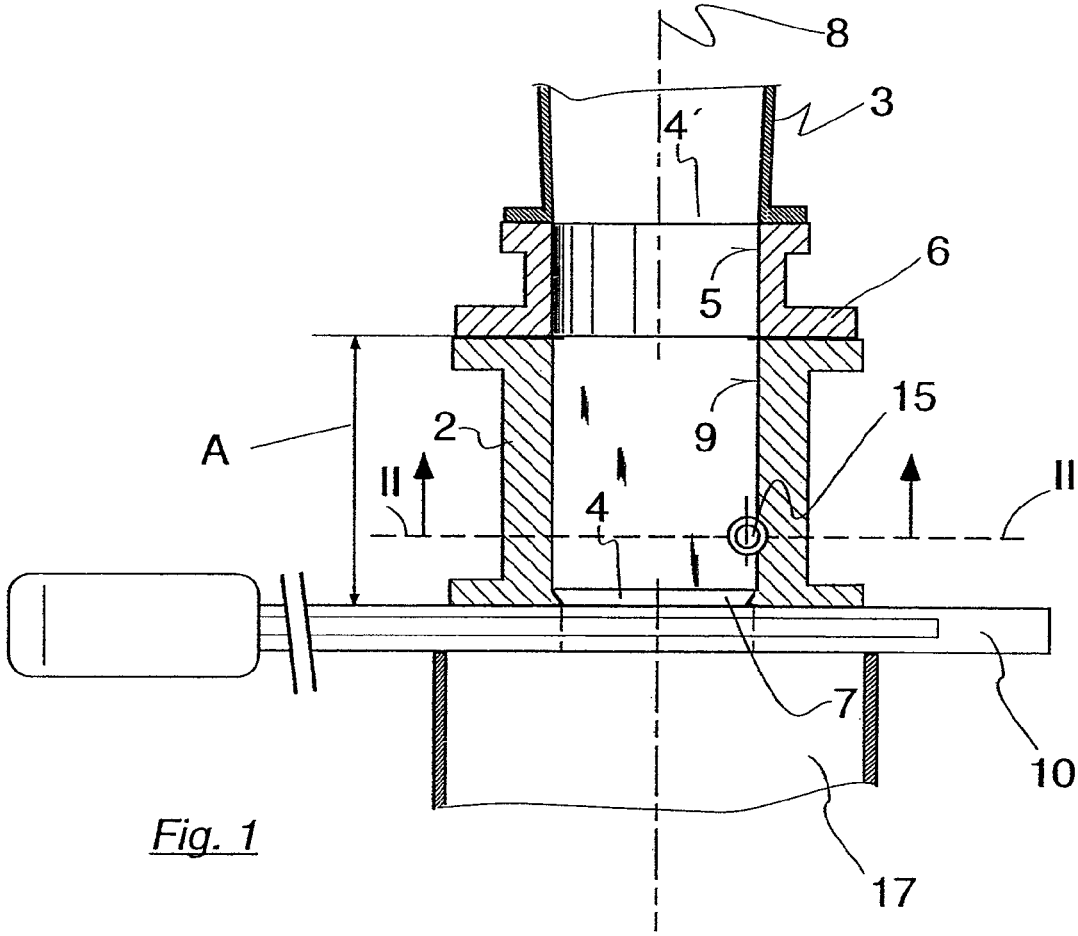
FIG. 1 illustrates an axially parallel section through a device according to the invention.

In a manner known per se a suspension with accumulated heavy contaminants is removed from a hydrocyclone 3 (only the lower part is drawn in FIG. 1) through a first heavy contaminants outlet 4' into a cylindrical attachment part 6 generally lying beneath it. The heavy contaminants then settle in a connection part 2 until actuation of a slider 10 results in the heavy contaminants being conveyed into a junk trap 17. Attachment part 6 can be provided with a wear-resistant lining 5, e.g., a ceramic liner. FIG. 1 shows a side sectional view through connection part 2 embodied or formed according to the invention. An inner surface 9 of connection part 2 is a polygon, e.g., a regular quadrangle, and this polygonal cross section can be constant over the entire axial extension A or, as shown in this exemplary embodiment, a constriction 7 can be provided near the end of axial extension A and, therefore, near heavy contaminants outlet 4. In this regard, it is noted the constriction reduces the cross section there to a circle again (see FIG. 2).

Axial extension A of connection part 2 is larger here than an inside diameter of attachment part 6, and preferably 1.5 to 5 times larger. As a result of the separation processes in connection part 2, the heavy contaminants largely freed from fibers reach the lower area of connection part 2 and, e.g., if slider 10 is open, can reach a junk trap 17 (cf. FIG. 3) located below it. As an alternative, connection part 2 could be formed as a junk trap that is closed at the top and at the bottom with sliders. Although the use of a junk trap is a common way, it is understood it is certainly not the only way, of removing heavy contaminants from the hydrocyclone. By way of example, it is also conceivable to draw off continuously the accumulating mixture of water and heavy contaminants.

Figure 2:
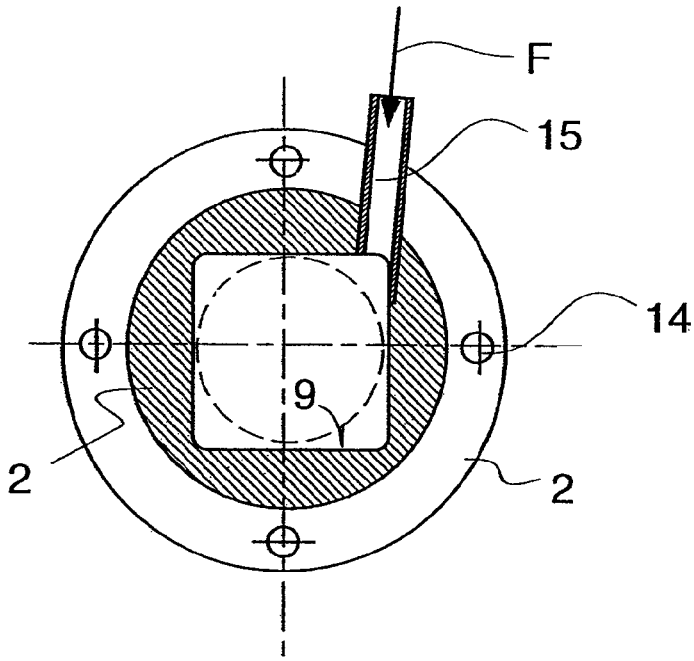
FIG. 2 illustrates a section of the device depicted in FIG. 1 along line II.

Viewed axially, attachment 15 for addition of liquid F is arranged particularly advantageously in the polygonal cross sectional area of connection part 2, e.g., as shown in the illustrated embodiment, in a lower third. As FIG. 2 shows, attachment 15 can be attached tangentially to connection part 2. Moreover, an inflow direction at attachment 15 can be opposite to the direction of rotational flow in connection part 2. Connection part 2 can be detachably fastened, e.g., with screws 14, and thus fastened in an easily replaceable manner to cylindrical connection part 6 lying above.

Figure 3:
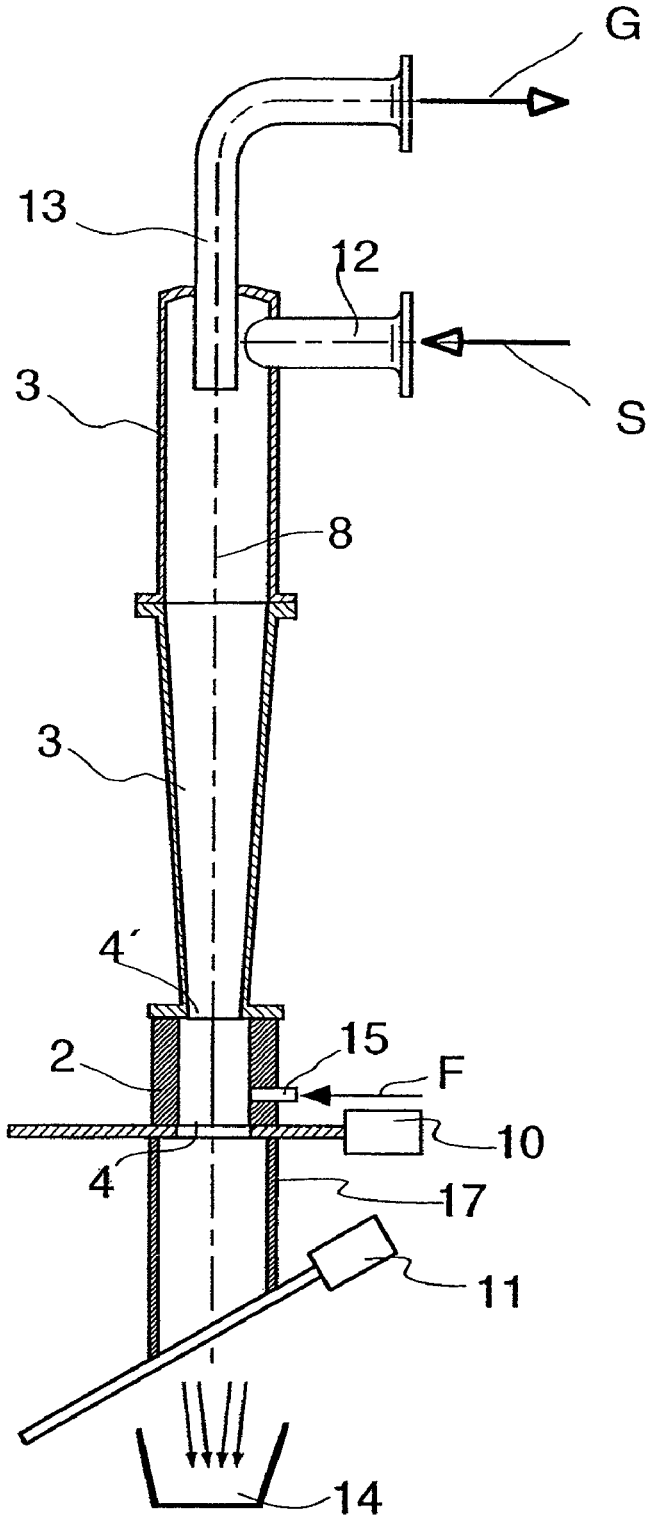
FIG. 3 illustrates a hydrocyclone in combination with the device according to the invention and a junk trap.

FIG. 3 shows a hydrocyclone 3 that is equipped with the device according to the invention, whereby connection part 2 opens into a junk trap 17 with an upper slider 10 and a lower slider 11. As shown in this exemplary embodiment, connection part 2 can be directly connected to hydrocyclone 3, rather than the indirect connection through attachment part 6, as described above with regard to FIG. 1. Fibrous suspension S can be pumped tangentially via an inlet attachment 12 into an interior of hydrocyclone 3 and set into rotation. Centrifugal forces can thus be used in a known manner for separation of heavy contaminants and fibrous suspension. The cleaned suspension can be carried off as accepts G through accepts pipe 13 arranged centrally above. The suspension with a large amount of accumulated heavy contaminants reaches connection part 2 attached below. The heavy contaminants washed out virtually free of fibers therein can then pass through slider 11 into junk trap 17 located below it. It can be advantageous to utilize two sliders 10 and 11 that cycled by a corresponding control device so that the heavy contaminants can fall into heavy-contaminant trough 14 at adjustable intervals.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A device for removing heavy contaminants from an apparatus for treating a fibrous suspension, comprising:

at least one connection part being one of directly and indirectly coupleable to a heavy contaminants outlet of the apparatus; and the at least one connection part comprising an inner surface having a polygonal cross section, at least one heavy contaminants outlet, and at least one attachment for adding liquid; and wherein the at least one attachment opens in an area of the polygonal inner surface and wherein the apparatus comprises a hydrocyclone for separating heavy contaminants from a fibrous suspension.

2. The device in accordance with claim 1, wherein the at least one attachment is tangentially arranged on the at least one connection part.

3. The device in accordance with claim 1, wherein the apparatus comprises a hydrocyclone, and at least one connection part is coupleable to the hydrocyclone such that a centerline of the at least one connection part is aligned with a centerline of the hydrocyclone.

4. The device in accordance with claim 1, wherein the polygonal inner surface is essentially formed as a square.

5. The device in accordance with claim 4, wherein the square has rounded corners.

6. The device in accordance with claim 1, further comprising an attachment device positionable between the at least one connection part and the heavy contaminants outlet of the apparatus.

7. The device in accordance with claim 6, wherein the attachment device has a cylindrical wear-resistant lining.

8. The device in accordance with claim 6, wherein the wear-resistant lining is a ceramic liner.

9. The device in accordance with claim 1, further comprising two sliders arranged to embody the at least one connection part as a junk trap.

10. The device in accordance with claim 1, wherein the at least one connection part is formed with an axial extension greater than an inside diameter of the heavy contaminants outlet of the apparatus.

11. The device in accordance with claim 10, wherein the axial extension is 1.5 to 5 times larger than the inside diameter of the heavy contaminants outlet of the apparatus.

12. The device in accordance with claim 1, wherein the at least one connection part is detachably coupleable to apparatus.

13. A method of removing heavy contaminants from a fibrous suspension, comprising:

separating heavy contaminants from a suspension in a separating device; and receiving the heavy contaminants in a connection part coupleable to a heavy contaminants outlet of the separating device, wherein the connection part has a cross sectionally polygonal inner surface; and wherein the separating device comprises a hydrocyclone, adding fluid to the connection part and removing the heavy contaminants from the connection part through activation of a slider.

* * * * *